US005782662A

United States Patent [19]

Icenogle

[11] Patent Number: 5,782,662

[45] Date of Patent: Jul. 21, 1998

[54] HYDRAULIC MARINE JACK PLATE

[76] Inventor: Robert O. Icenogle, 1501 33rd. St. SE., Ruskin, Fla. 33670

[21] Appl. No.: 808,461

[22] Filed: Mar. 3, 1997

Related U.S. Application Data

[63] Continuation-in-part of Ser. No. 511,105, Aug. 4, 1995, abandoned.

[51] Int. Cl.[6] ..... B63H 21/26

[52] U.S. Cl. ..... 440/61; 248/641

[58] Field of Search ..... 440/53, 59, 61, 440/900; 248/640, 641

[56] References Cited

U.S. PATENT DOCUMENTS 4,907,993 3/1990 Thompson ..... 440/61
5,100,349 3/1992 Perkins et al. ..... 440/61
5,484,311 1/1996 Detwiler et al. ..... 440/61

*Primary Examiner*—Ed L. Swinehart
*Attorney, Agent, or Firm*—Donald R. Bahr

[57] ABSTRACT

A powered jack plate for use with a marine outboard motor in a marine environment; the inward side of the jack plate is attached to the transom of a boat; the outboard motor is attached to the outward side of the powered jack plate; hydraulic power is the preferred power source, hydraulic fluid being supplied by a separate hydraulic pump; the jack plate comprises a pair of opposing supports which are interconnected by support bars; the opposing supports incorporate linear bearings in which rides a slide which is capable of vertical movement; the linear bearings are provided with grease fittings for positive lubrication; the outward side of the opposing supports is higher than the inward side thereby permitting maximum upward travel of the slide and the linear bearings are locked into the opposing supports via an undercut groove which is integral with these supports.

23 Claims, 3 Drawing Sheets

9
50
56
9
2
13
54
6
32
31
8
9
15
14
38
9
44
5
64
48
42
8
8
15
62
6
36
52
60
36
32
31
4
29
44
7
32
64
6
4
62
48
31
60
7
4
42

HYDRAULIC MARINE JACK PLATE

RELATED APPLICATION

This application is a continuation in part application of application Ser. No. 08/511,105 filed Aug. 4, 1995, now abandoned.

FIELD OF THE INVENTION

This invention is concerned with hydraulic marine jack plates which are commonly used in conjunction with outboard motors. Most larger outboard motors are supplied with integral hydraulic motors and related hydraulic cylinders wherein the outboard motor can be angularly disposed in relation to the transom of a boat to which it is attached. While this angular disposition of an outboard motor in relation to the transom of a boat is useful, in many situations it has been found that it is highly desirable to move an outboard motor vertically in a plane which is parallel with the transom of a boat. It is in this field that the hydraulic jack plates of this invention are useful.

When a hydraulic jack plate is used to move an outboard motor vertically up the efficiency of the outboard motor can be greatly enhanced particularly in high speed operation. In many instances when an outboard motor and the boat to which it is attached is operating at high speeds the lower unit of the outboard motor creates excessive drag which impairs the operating efficiency of the outboard motor and the boat to which it is attached.

By the use of a hydraulic jack plate an outboard motor can be moved in a vertical plane in order that the outboard motor and boat combination can achieve optimum operating efficiency under all operating conditions.

Further by use of a hydraulic jack plate an outboard motor can be moved up in order to allow the outboard motor and boat combination to operate in shallow water. In many instances by using a hydraulic jack plate and moving the outboard motor up most boats can operate in water which is only a few inches deeper than the draft of the particular boat.

The subject inventions is concerned with improvements wherein the operation of a marine hydraulic jack plate can be greatly enhanced.

These enhancements are achieved by decreasing the weight of the hydraulic jack plate, by increasing the height which the hydraulic jack plate will travel, by providing a superior bearing arrangement and by providing a positive lubricating system.

Accordingly, it is an object of this invention to provide a hydraulic jack plate which will rise higher than prior art hydraulic jack plates.

Likewise, it is an object of this invention to provide a hydraulic jack plate wherein superior bearings are provided for.

It is a further object of this invention to provide a hydraulic jack plate which is lighter than the hydraulic jack plates of the prior art.

It is also an object of this invention to provide a hydraulic jack plate which has positive lubrication capabilities.

These objects and advantages should be construed as merely illustrative of some of the more prominent features and applications of the present invention. Accordingly, other objects and advantages, as well as a fuller understanding of the invention, may be had by referring to the summary and detailed description of the preferred embodiment of the invention in addition to the scope of the invention, as is defined by the specifications and claims taken in conjunction with the accompanying drawings.

SUMMARY OF THE INVENTION

The present invention is defined by the appended claims with the specific preferred embodiment shown in the attached drawings. For the purpose of summarizing the invention, the invention may be defined as a superior hydraulic jack plate which is lighter than the prior art hydraulic jack plates, has superior bearings, has positive lubrication and will move higher than the prior art structures.

Hydraulic jack plates comprise four main components these being hydraulic pump, a hydraulic cylinder, a support which is attached to the transom of a boat and a slide which moves in the support and to which the outboard motor is attached.

Linear bearings are provided between the support and the slide. These bearings have proved to be troublesome in the prior art as they tend to quickly wear out and or deform. Further the prior art jack plates tended to use linear bearings which did not have optimum lubricating properties. Likewise, the means whereby these linear bearings were secured in place was inadequate. In the improved hydraulic jack plate of this invention bearings having outstanding lubricating properties are provided for. Further positive means of lubrication are provided for intermediate of the terminal ends of the linear bearings in which the slide moves.

In the hydraulic jack plate of this invention the support is provided with an undercut bearing slot whereby the linear bearings may be rigidly secured to the support without the use of extraneous fasteners.

In order to provide a hydraulic jack plate which will move an outboard motor as high as possible the upper inward terminal edge of the support, adjacent to the transom, has been lowered in relation to the upper outward terminal edge of the support. This alteration of the relationship of the upper edges of the support results in an improved hydraulic jack plate which will raise an outboard motor approximately 15 to 25 percent higher than the prior art jack plates. Likewise all excess weight has been removed from the hydraulic jack plate of this invention.

The foregoing has outlined rather broadly the more pertinent and important features of the present invention in order that the detailed description of the invention that follows may be better understood. Additional features of the invention will be described hereinafter which form the subject of the claims of the present invention. It is appreciated by one skilled in the art, that the conception and the specific embodiment disclosed herein may be readily utilized as a basis for modifying or designing other apparatus or processes for carrying out the purposes of the present invention. It is also realized by one skilled in the art that such equivalent apparatus and process do not depart from the spirit and scope of the invention as set forth in the appended claims.

DESCRIPTIONS OF THE DRAWINGS

DESCRIPTION OF THE PREFERRED EMBODIMENT

As is generally discussed above the subject invention relates to an improved marine hydraulic jack plate for use with outboard motors.

Figures 1, 2, 3, 4:
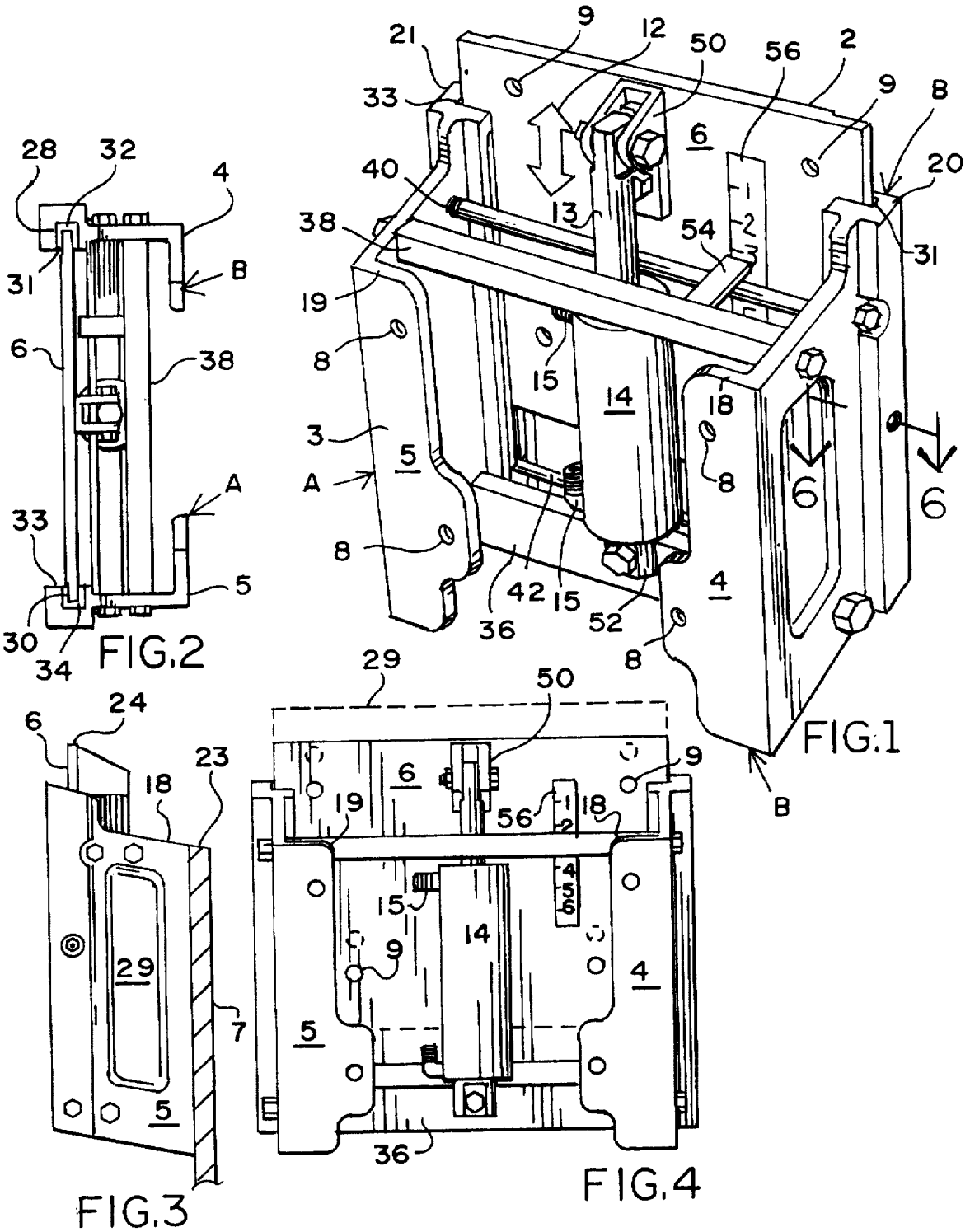
FIG. 1 is a perspective view showing the hydraulic jack plate of this invention.
FIG. 2 is a top plan view showing the hydraulic jack plate of this invention.
FIG. 3 is a side view showing the hydraulic jack plate of this invention.
FIG. 4 is a rear view showing the hydraulic jack plate of this invention.
Figure 8:
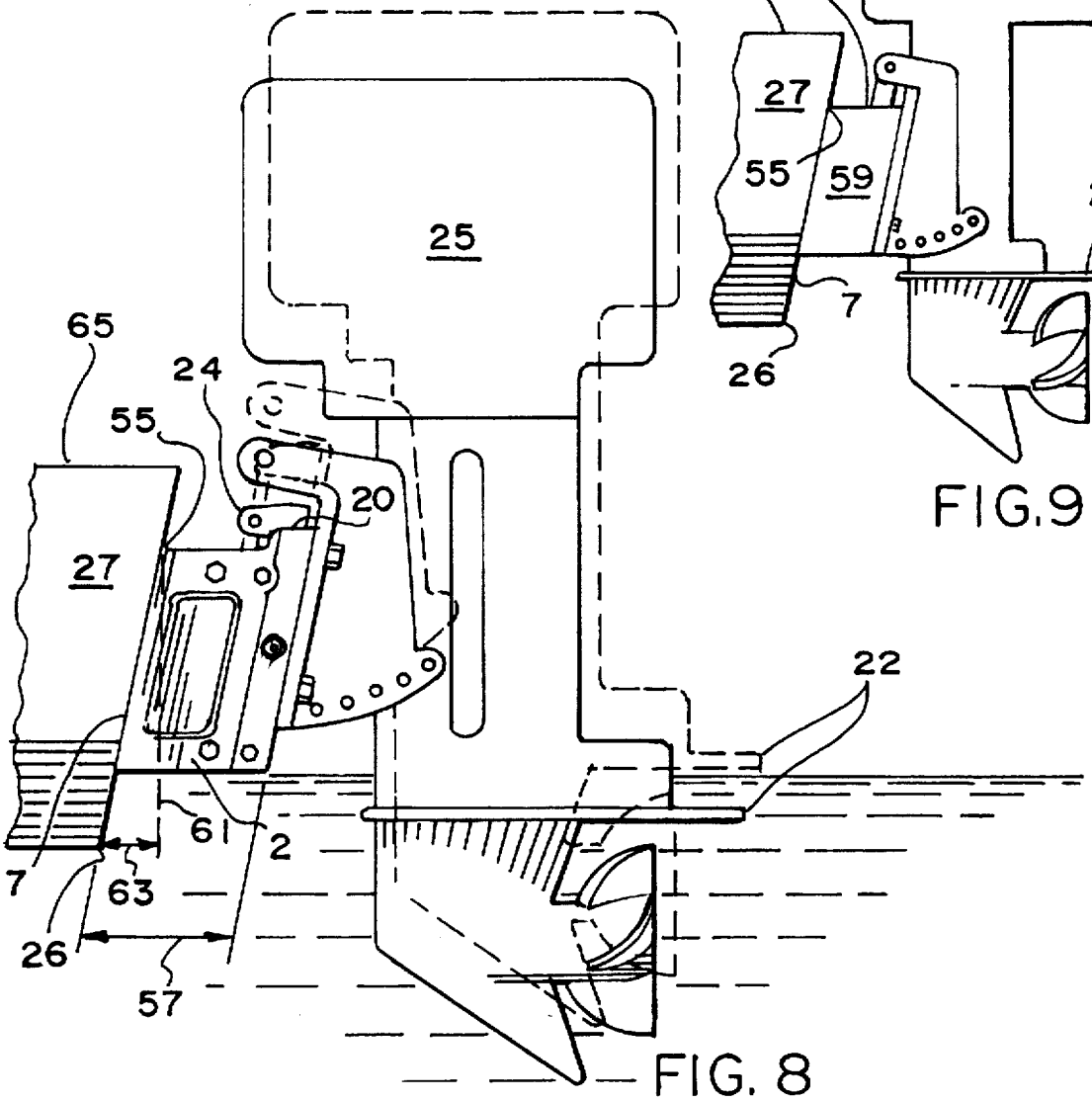
FIG. 8 is a side view showing the jack plate of this invention attached to a boat and an outboard motor attached to the hydraulic jack plate.

Referring to FIGS. 1 and 8 it can be seen that hydraulic jack plate 2 of this invention incorporates a plurality of components. These components generally comprise a pair of opposing supports 4 and 5 which are attached to the transom 7 of a boat 27 shown in partial section. This attachment is effected by bolts (not shown) which are passed through aperture 8 and through the boat transom 7 in a conventional manner.

In the broadest embodiment the hydraulic jack plate 2 of this invention comprises a support 3 which in the illustrated structure of FIG. 1 comprises support members 4 and 5, a plurality of support bars and a slide 6 which can move up and down in a vertical plane. Support 3 has a first planar surface A which is adapted to being secured to the transom of a boat and a second planar surface B which is adapted to slideably engage slide 6.

Positioned in supports 4 and 5 is a slide 6 which can move up and down in a vertical plane in the directions of arrow 12.

As is shown in FIG. 2 slide 6 is positioned in a pair of linear bearings 32 and 34 which are integral with supports 4 and 5. The details of these bearings and their attachments to supports 4 and 5 will be described herein below.

Slide 6 and support 3 are further interconnected by a hydraulic cylinder 14 which is attached to support 3, the piston thereof being attached to slide 6 via shaft 13.

Hydraulic cylinder 14 is powered by hydraulic fluid which is provided for by a hydraulic pump (not shown). The hydraulic fluid being transferred from the hydraulic pump to hydraulic cylinder 14 via hydraulic lines 15 which interconnect the hydraulic pump and hydraulic cylinder 14. Hydraulic jack plates which are powered with a hydraulic cylinder and a hydraulic pump as described above are conventional in the prior art.

As can be further seen from FIGS. 1 and 8 the upper inward terminal edges 18 and 19 of supports 4 and 5 adjacent to the boat transom 7 are lower than upper outward terminal edges 20 and 21 of supports 4 and 5 therefore when slide 6 is in the full downward position as is shown in FIGS. 3 and 4 the upper terminal edge 24 of slide 6 is higher than the upper edge 55 of transom 7.

The upper outward edge 20 of support 4 are of such a height that when slide 6 is in the full downward position the cavitation plate 22 of outboard motor 25 is approximately the same height as keel 26 of boat 8. This positioning allows outboard motor 25 to be positioned at the lowest possible desired point and yet permits maximum upward travel. The scope of the upward travel is further enhanced by the fact that the upper outward terminal edges 20 and 21 of support 4 and 5 are higher than the inward terminal edges 18 and 19 of supports 4 and 5. This maximum upward movement is particularly useful when a boat is to be operated in very shallow water for example when a boat is used for grass flats fishing. The full advantages of this feature can best be optimized if the particular outboard motor is altered to allow cooling water to be picked up at a point which is lower than that provided for in stock outboard motors.

Figure 9:
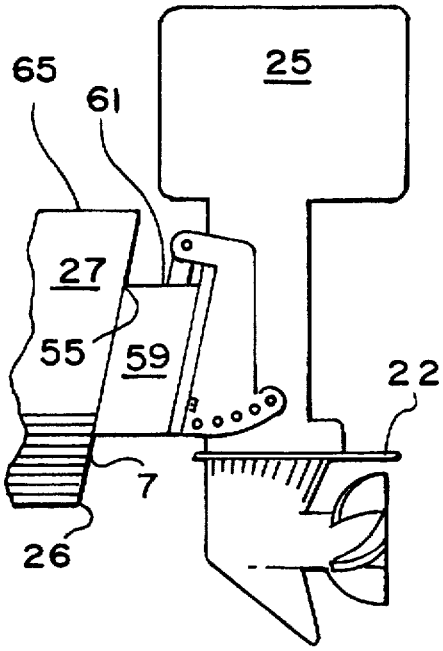
FIG. 9 is a side view showing a prior art jack plate.

Jack plate 2 is attached to transom 7 of boat 27 via bolts which pass through apertures 8. In turn outboard motor 25 is attached to slide 6 via bolts which pass through apertures 9, which are integral with slide 6, and through the support structure of outboard motor 25 As is illustrated in FIG. 9 when a hydraulic plate is attached to transom 7 of boat 27 surface B of jack plate 2 is canted downward as a result of the 12 degree transom angle of boat 27. All outboard motors are designed to function on boats with transom angles of about 12 degrees.

The vertical movement of slide 6 is shown in FIG. 4 wherein this movement is demonstrated by showing upper edge 24 of slide 6 in a phantom line 29.

Figures 5, 6, 7:
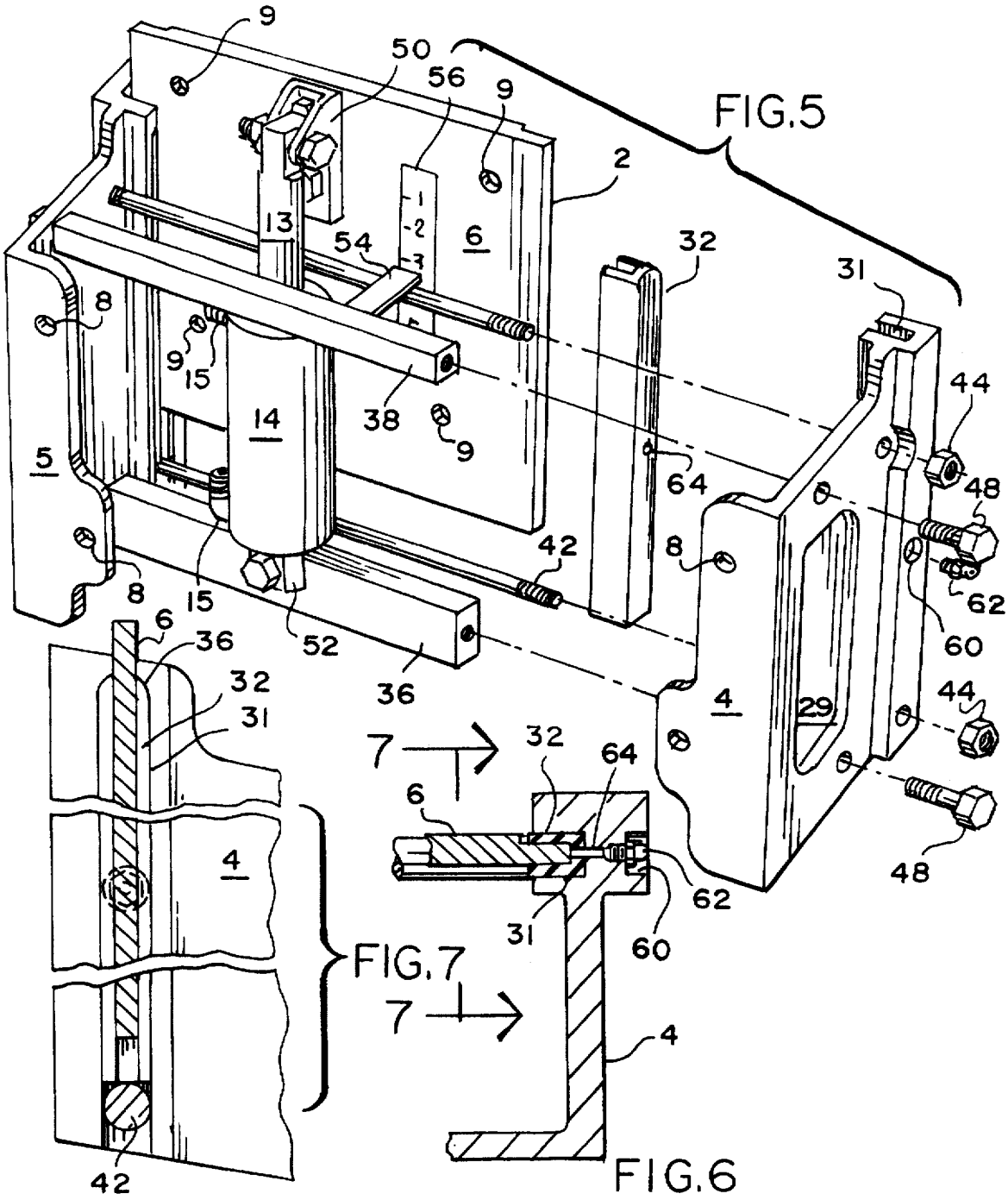
FIG. 5 is a perspective view showing the assembly of the components of the hydraulic jack plate of this invention.
FIG. 6 is a sectioned view along line 6—6 of FIG. 1.
FIG. 7 is a sectioned inside side view showing the support of the hydraulic jack plate of this invention.

The further assembly of jack plate 2 is illustrated in FIG. 5 wherein it can be seen that opposing supports 4 and 5 are interconnected via two support bars 36, and 38 and tensioning rods, 40 and 42. These components are fastened to supports 4 and 5 via nuts 44 and bolts and 48 in a conventional manner.

When nuts 44 are loosened and tightened the functional length of tensioning rods 40 and 42 between supports 4 and 5 is altered. By alternately tightening up on and loosening up on nuts 44 which are attached to tensioning rods 40 and 42 the planar relationship of supports 4 and 5 may be altered slightly in order to keep supports 4 and 5 in a parallel relationship with each other. Having supports 4 and 5 in parallel planar relationship with each other is desirable as only when this planar relationship is achieved can slide 6 move freely in the directions of arrow 12. This adjustment is necessary in order to adjust the planar relationship of supports 4 and 5 when they become misaligned in the attachment to transom 7. Further by altering the tension on tensioning rods 40 and 42 by loosening or tightening nuts 44 it is possible to keep proper tension on bearings 32 and 34.

Slide 6 is attached to support 36 via hydraulic cylinder 14 and shaft 13. The attachment to slide 6 is effected via bracket 52.

Means are further provided whereby the relative height of slide 6 can be determined in relation to a base level. This means comprises a slight bar 54 and a graduated scale 56.

The above described jack plate wherein the outward upper terminal edges of opposing supports 4 and 5 are higher than the opposite inward terminal edges provides an arrangement wherein slide 6 and hence outboard motor 25 may be moved to the maximum height allowable by the travel of shaft 13. That is the maximum travel capabilities of hydraulic cylinder 14 may be utilized in order to raise outboard motor 25 to the maximum height and yet provide an arrangement wherein slide 6 is still sufficiently supported when motor 25 is raised to the maximum height. This maximum upward movement is possible as when hydraulic jack plate 2 is attached to boat 27 and slide 6 is all the way down the upper edge of slide 6 is higher than edge 55 of transom 7. In the prior art because of the cant caused by the transom angle of the boat edge 6 would be lower than edge 55.

The inner upper terminal edges of the supports for the prior art jack plates are typically about the same height as the outer upper terminal edges. A marine jack plate is about 6 inches thick. Therefore when an outboard motor is placed on a boat via a jack plate it is set back about 6 inches. Boat transoms are canted inward at an angle of about 12 degrees. As a result of this cant an outboard motor when attached to a boat via a prior art jack plate the outboard motor, is lower than or about the same height, as the top 55 of transom 7, this is illustrated in FIG. 9.

In accordance with this invention upper edge 20 of jack plate 2 is actually higher than the upper edge 55 of transom 7. This is acceptable as for every inch a outboard motor is moved backward as a result of the thickness of the jack plate cavitation plate 22 may be moved upward approximately ½" in relation to keel 26. By use of this invention this phenomena can be compensated for, and put to good use such that the full travel of hydraulic cylinder 14 can be used in order to raise outboard motor 25 to the maximum height thereby permitting boat 67 to operate in very shallow water.

In accordance with this invention the outward edge 20 of hydraulic jack plate 2 is approximately 1 to 3 inches higher than the upper edge 55 of transom 7. To put this height difference in another perspective the outward edge 20 of jack plate 2 in accordance with this invention is higher than inner edge 18 by an amount which is from about 15 to about 50% of the thickness of hydraulic jack plate 2 this thickness being illustrated by arrow 57 of FIG. 8.

In the preferred embodiment of this invention this height difference is about 25% of the thickness of the hydraulic jack plate.

Likewise it can be seen from FIG. 1 that hydraulic jack plate 2 and in particular supports 4 and 5 have been altered to achieve maximum weight reduction by providing a substantial oval milled out skeletonized section 29 only one side of jack plate 2 being shown.

Referring to FIGS. 2, 6 and 7 it can be seen that supports 4 and 5 are provided with a pair of grooves 31 and 33 in which are placed a pair of linear bearings 32 and 34. The retention of linear bearings 32 and 34 in grooves 31 and 33 has proved to be a problem in the prior art. Typically in the prior art these linear bearings are retained in place with a plurality of screws or bolts. Because bearings 32 and 34 are often formed from a thermoplastic material in the prior art these bearings were often forced upward and out of grooves 31 and 33 by the frictional contact of slide 6 with the bearing, when slide 6 is raised.

In order to eliminate this problem in the structure of this invention the upper edges of grooves 31 and 33 are radiused as is shown in enlarged FIG. 7.

The undercut 36 which is created by this pair of radiuses prevents linear bearings 32 and 34 from being pulled out of grooves 31 and 33 during the upward travel of slide 6.

The upper terminal edges of bearings 32 and 34 are formed such that they correspond to the shape of undercut 36. This undercutting arrangement provides a positive arrangement whereby linear bearings 32 and 34 may be secured in supports 4 and 5 support 4 only being illustrated.

The downward movement of linear bearing 32 and 34 in grooves 31 and 33 is prevented by tensioning rod 42 which passes through apertures which are integral with grooves 31 and 33.

The lateral movement of bearings 32 and 34 is prevented by the contact of the inner byte of these bearings with the lateral edges of slide 6. As can be seen from the above description by use of this invention the linear bearings are secured in supports 4 and 5 in all possible planes of movement, without the use of extraneous fasteners.

In many prior art structures linear bearings utilized are formed from thermoplastic materials such as medium and high density polyethylene. In addition polyacetal thermoplastic have been used as bearing materials.

It has been found that the use of a polyacetal material which is alloyed with Teflon provides optium results.

The preferred material for use in forming linear bearings 32 and 34 is DELRIN 100AF as is sold by DePont Pont Polymers, Wilmington, Del. 19880.

DELRIN 100AF has been found to have the ideal combination of toughness, chemical resistance and lubricity.

Regardless of the inherent lubricity properties of bearings 32 and 34 the jack plate of this invention is provided with a pair of opposing lubricating ports 58 and 60 only port 60 being shown whereby grease can be injected into bearings 32 and 34 and around the vertical edges of slide 6. Port 60 registered with port 64 which is integral with linear bearing 32. In the preferred embodiment ports 58 and 60 incorporate ZERK fittings. Fitting 62 being illustrated.

The hydraulic jack plate of this invention is preferably formed from aluminum, supports 4 and 5 being formed from extruded stock and slicd 6 being formed from plate stock.

As is mentioned above power boats incorporate a transom angle of about 12 degrees. This transom angle is defined by the plane of transom 7 and dotted line 61. As is illustrated in FIG. 8 this transom angle if further illustrated in FIG. 8 by arrow 63. Dotted line 61 is at right angles to keel 26. It is this defined transom angle that makes the subject invention desirable and advantageous. Because outboard motors are designed for use with a 12 degree transom angle this transom angle is necessary in a power boat in order that outboard motor attached thereto function properly.

In fact BIA (Boating Institute of America) recommends to its members that all power boats be build with a 12 degree transom angle. Further this 12 degree transom angle is recognized worldwide.

Figure 10:
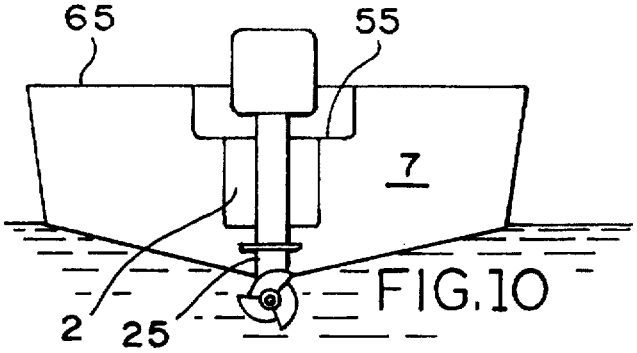
FIG. 10 is a rear view of a boat with a jack plate and outboard motor attached thereto.

Referring to FIG. 9 it can be seen that some prior art jack plate 59 have upper edges 61 which cant slightly upward in relation to inner edge of the jack plate this upward cant of the prior art jack plate compensates for the inward cant of the transom in order to allow the outer edge of the jack plate to be the same height as edge 55 of transom 7. As is shown in FIG. 10 edge 55 is located in a cut out position of transom 7. This slight upward cant has been found insufficient to allow for the full upward travel of hydraulic cylinder 14 in such a manner that outboard motor 25 can be moved upwardly to the maximum height. In fact this upward cant of the prior art jack plates only compensates for the transom angle which is usually about 12 degrees.

As is discussed above outboard motor 25 can be moved upward in relation to keel 26 as a result of the thickness 57 of jack plate 2. The fact that the outer edges 20 and 21 are higher than inner edges 18 and 19 on jack plate 2 of this invention allows this phenomena to be put to good usage.

The above description and drawings are illustrative of modifications that can be made without departing from the present invention, the scope of which is to be limited only by the following claims.

What is claimed is:

1. A hydraulic marine jack plate for use with an outboard marine engine, which will allow generally vertical movement of the outboard marine engine in a plane which is parallel with the transom of a boat when said jack plate is attached to said transom comprising: a support having first and second planar sides, said first planar side having an inward upper terminal edge and said first planar side being adapted to being secured to the transom of a boat, said second planar side having an outward upper terminal edge and said second planar side being adapted to receive a slide member such that said slide member can move up and down in a plane which is approximately parallel with the transom wherein said support member and said slide are interconnected by a hydraulic cylinder which is in turn connected to a source of hydraulic power and wherein when said jack plate is attached to the transom of a boat having a transom angle of about 12 degrees, the inward upper terminal edge of said support adjacent said first planar side is lower than outward upper terminal edge, adjacent said second planar side wherein this difference in the height between the outward upper terminal edge and the inward upper terminal edge is from about 15 to about 50 percent of the distance between said first and second planar sides.

2. The hydraulic jack plate of claim 1 wherein said support comprises a pair of opposing support members which are interconnected by at least two lateral support bars.

3. The hydraulic jack plate of claim 1 wherein said support incorporates at least one groove which is adapted to receive and slideably engage said slide member wherein said groove is approximate said second planar side.

4. The hydraulic jack plate of claim 2 wherein said support incorporates at least one groove which is adapted to receive and slideably engage said slide member wherein said groove is approximate said second planar side.

5. The hydraulic jack plate of claim 1 wherein said support incorporates a pair of opposing, inward facing U shaped grooves which are adapted to receive and slideably engage said slide member wherein said grooves are approximate said second planar side.

6. The hydraulic jack plate of claim 2 wherein said support incorporates a pair of opposing, inward facing U shaped grooves which are adapted to receive and slideably engage said slide member wherein said grooves are approximate said second planar side.

7. The hydraulic jack plate of claim 3 wherein said groove further incorporates a linear bearing.

8. The hydraulic jack plate of claim 4 wherein said groove further incorporates a linear bearing.

9. The hydraulic jack plate of claim 5 wherein said grooves further incorporate U shaped linear bearings and the upper inside width of said grooves is less than the upper outward width of said linear bearings.

10. The hydraulic jack plate of claim 6 wherein said grooves further incorporate U shaped linear bearings and the upper inside width of and grooves is less than the outward width of said linear bearings.

11. The hydraulic jack plate of claim 1 wherein the movement of said slide is also approximately parallel with said transom.

12. The hydraulic jack plate of claim 9 wherein the movement of said slide is also approximately parallel with said transom.

13. The hydraulic jack plate of claim 5 wherein said grooves incorporate passages whereby grease can be injected into said grooves.

14. The hydraulic jack plate of claim 6 wherein said grooves incorporate a passage whereby grease can be injected into said grooves.

15. The hydraulic jack plate of claim 9 wherein said grooves and said linear bearings incorporate registering passages whereby grease may be injected into said bearings.

16. The hydraulic jack plate of claim 10 wherein said grooves and said linear bearings incorporate registering passages whereby grease may be injected into said bearings.

17. The hydraulic jack plate of claim 1 wherein the support member is skeletonized in order to reduce weight and is formed from aluminum.

18. The hydraulic jack plate of claim 15 wherein the support member is skeletonized in order to reduce weight and is formed from aluminum.

19. The hydraulic jack plate of claim 1 wherein the upper inward terminal edge of said support adjacent said first planar side is from about 1.5 to about 2.5 inches lower than the outward terminal edge adjacent said second planar side.

20. The hydraulic jack plate of claim 9 wherein the upper inward terminal edge of said support adjacent said first planar side is from about 1.5 to about 2.5 inches lower than the outward terminal edge adjacent said second planar side.

21. The hydraulic jack plate of claim 2 wherein said opposing support members are interconnected by at least one tensioning rod wherein altering the tension on said tensioning rod will alter the parallel relationship of said opposing support members.

22. The hydraulic jack plate of claim 10 wherein said opposing support members are interconnected by at least one tensioning rod wherein altering the tension on said tensioning rod will alter the parallel relationship of said opposing support members.

23. The hydraulic jack plate of claim 22 wherein said opposing support members are interconnected by at least one tensioning rod, wherein altering the tension on said tensioning rod will alter the parallel relationship of said opposing support members, wherein the upper inward terminal edge of said support adjacent said first planar side is about 1.5 inches lower than the upper outward terminal edge of said second support and wherein the distance between the first and second planar sides is about 6 inches.

* * * * *